US008784579B2

(12) United States Patent
Buha

(10) Patent No.: US 8,784,579 B2
(45) Date of Patent: Jul. 22, 2014

(54) MAGNESIUM GRAIN REFINING USING VANADIUM

(76) Inventor: Joka Buha, Sydney (AU)

( * ) Notice: Subject to any disclaimer, the term of this patent is extended or adjusted under 35 U.S.C. 154(b) by 614 days.

(21) Appl. No.: 12/936,910

(22) PCT Filed: Apr. 20, 2009

(86) PCT No.: PCT/AU2009/000473

§ 371 (c)(1),
(2), (4) Date: Oct. 8, 2010

(87) PCT Pub. No.: WO2009/129559

PCT Pub. Date: Oct. 29, 2009

(65) Prior Publication Data

US 2011/0036466 A1 Feb. 17, 2011

(30) Foreign Application Priority Data

Apr. 22, 2008 (WO) ..... PCT/AU2008/901980

(51) Int. Cl.

| | |
|---|---|
| ***C22C 23/00*** | (2006.01) |
| *B22D 17/00* | (2006.01) |
| *C22B 26/00* | (2006.01) |

(52) U.S. Cl.
USPC ..... 148/420; 75/600; 148/538; 420/402

(58) Field of Classification Search
USPC ..... 148/420, 538; 75/600; 420/402
See application file for complete search history.

(56) References Cited

U.S. PATENT DOCUMENTS

| | | | | |
|---|---|---|---|---|
| 3,240,593 | A | 3/1966 | Schneider et al. | |
| 5,501,748 | A * | 3/1996 | Gjestland et al. | 148/538 |
| 6,395,224 | B1 * | 5/2002 | Nishino et al. | 420/413 |
| 6,616,729 | B2 | 9/2003 | Motegi et al. | |
| 6,689,193 | B1 | 2/2004 | Hisoe et al. | |
| 2004/0025632 | A1 | 2/2004 | Boily et al. | |
| 2005/0208324 | A1 * | 9/2005 | Oishi et al. | 428/654 |
| 2007/0227629 | A1 * | 10/2007 | Gerold et al. | 148/420 |
| 2008/0031765 | A1 * | 2/2008 | Gerold et al. | 420/404 |
| 2008/0216924 | A1 * | 9/2008 | Schumacher et al. | 148/538 |
| 2009/0032151 | A1 * | 2/2009 | Oishi et al. | 148/667 |

* cited by examiner

*Primary Examiner* — Keith Walker
*Assistant Examiner* — Alexander Polyansky

(57) ABSTRACT

A process of grain refining magnesium metal or magnesium based alloy including the step of a) providing a melt of the magnesium metal or magnesium based alloy, said melt including a grain refining agent in an amount effective to induce grain refinement of said magnesium or magnesium based alloy upon solidification, wherein the grain refining agent is vanadium metal, where said grain refinement comprises a reduction in average grain size of at least 50% (percent) as compared with the average grain size without addition of said grain refining agent.

14 Claims, 4 Drawing Sheets

MAGNESIUM GRAIN REFINING USING VANADIUM

FIELD OF THE INVENTION

This patent application claims priority from the Australian provisional application for patent AU2008901980 filed on 22 Apr. 2008. This invention relates to a method for improving physical properties of cast and wrought magnesium alloys by producing finer grain sizes in these materials. This invention more specifically relates to the use of a small amount of vanadium metal as a grain refiner in such magnesium alloys.

BACKGROUND TO THE INVENTION

Reduction of grain size represents one of the most effective methods for improving the mechanical properties of polycrystalline materials such as metallic alloys. The mechanical properties of magnesium alloys are particularly sensitive to grain size. Depending on the alloy type/composition and application, the formation of fine and preferably uniform grain structure is commonly achieved either by the use of grain refiners during alloy making and other treatments of the liquid alloy, by special casting procedure (eg. high pressure die casting), or by a processing route invoking severe plastic deformation. The use of grain refiners represents the most suitable and most widely applicable method for grain refining of magnesium metal and magnesium alloys.

One of the most effective and most common grain refiners is zirconium. However, the use of this element has been limited to magnesium alloys that do not contain alloying elements such as aluminium or manganese. Accordingly, all magnesium alloys have been classed in two groups: Zr-containing and Zr-free. For the Zr-free alloys, a number of different methods of grain refining have been developed. These include superheating, carbon addition, additions of carbon-bearing particles and some ceramic particles such as $Al_4C_3$, AlN, SiC, TiC, $CaC_2$, $FeCl_3$, $C_2Cl_6$, $CCl_4$ and also elements such as Y, B, Ce, La, Nd, and Sr. Among these methods, superheating and addition of carbon and carbon-bearing compounds, as well as the use of $FeCl_3$, have found some industrial application. The drawbacks of superheating method are great energy consumption due to very high operating temperatures required and safety issues. Grain refinement using $FeCl_3$ results in the reduction of alloy corrosion resistance. Compounds such as $C_2Cl_6$ or $CCl_4$ have also been used, however due to the release of toxic dioxins, the use of these compounds has serious environmental drawbacks. In addition, none of these methods is readily applicable to a wider group of alloys or universally applicable to all magnesium alloys.

Development of alternative and effective grain refiner and an improved method of grain refining applicable to a wider group of magnesium alloys is still needed. Ultimately, universal grain refiner that can effectively grain refine all or most magnesium alloys is required. Grain refiners that have additional beneficial effects on magnesium and its alloys are peritcularly highly desirable and their use would be highly economical.

SUMMARY OF THE INVENTION

According to the present invention, there is provided a process of grain refining magnesium metal or magnesium based alloy including the step of a) providing a melt of the magnesium metal or magnesium based alloy, said melt including a grain refining agent in an amount effective to induce grain refinement of said magnesium or magnesium based alloy upon solidification, wherein said grain refining agent is vanadium metal, where said grain refinement comprises a reduction in average grain size of at least 50% (percent) as compared with the average grain size without addition of said grain refining agent. The present invention also provides a magnesium metal or magnesium based alloy subjected to the process of grain refining including the step of a) providing a melt of the magnesium metal or magnesium based alloy, said melt including a grain refining agent in an amount effective to induce grain refinement of said magnesium or magnesium based alloy upon solidification wherein said grain refining agent is vanadium metal, where said grain refinement comprises a reduction in average grain size of at least 50% (percent) as compared with the average grain size without addition of said grain refining agent.

In accordance with a preferred embodiment of this invention a small amount of Vanadium metal is added to the magnesium metal or magnesium based alloy to reduce or refine average grain size in castings and wrought products obtained by processing cast ingots. Small amount of vanadium metal is added (i) to the melt of the magnesium metal or magnesium based alloy or (ii) melted together with the magnesium metal or magnesium based alloy and its components (alloying elements). Small amount of vanadium metal is added (iii) in the pure form, or (iv) in the form of a pre-alloy or master alloy of vanadium metal with one or more alloying elements intended to be present in magnesium alloy that is grain refined, since only a very small amount of vanadium metal containing grain refiner is required.

The amount of vanadium metal suitable for grain refinement is in the order of 0.3 wt % (weight percent) although a much smaller amount is sufficient especially if added as master alloy of low melting point. Without wishing to be restricted to a particular mechanism, it is suspected that vanadium dissolved in the liquid magnesium alloy precipitates out of the melt during alloy pouring thereby providing nucleation sites for the magnesium grains. Preferably an excess of vanadium metal may be added. This will ensure that excess vanadium can then dissolve in the liquid alloy to compensate for the vanadium losses due to its precipitation from the melt. An amount of about 2 wt % (weight percent) including the excess is sufficient to ensure successful grain refinement.

Melting vanadium metal grain refiner together with other magnesium alloy components is a simple procedure that eliminates a need for additional step of adding grain refiner to a melt of magnesium or magnesium based alloy, as is a common procedure with the use of many other grain refiners. This reduces the costs of grain refining process and that of the alloy.

As a master alloy, vanadium can be added in the form of an alloy with one or more of the alloying elements intended to be present in the magnesium alloy. Examples of such suitable master alloys are Zn—V, Al—V, Sn—V, Mn—V etc., although these examples do not limit the choice of the vanadium-containing master alloy. However, the presence of these alloying elements or any other chemical element in the combination with vanadium or in the magnesium alloy is not a prerequisite for vanadium metal to act as grain refiner and grain growth inhibitor in a magnesium metal or alloy. The use of some master alloys (Zn, Sn or Al-rich for example) as a source of vanadium metal allows for the use of lower temperatures during melting and grain refinement procedure (such as well below 750° C.). Vanadium metal or the vanadium containing master alloy can be added in the form of small pellets or fine particles which can assist faster and possibly better dissolution, in addition to slightly enhanced grain refining effect. However the form, shape and size of the vanadium added as grain refiner does not determine or limit its grain refining effectiveness.

The magnesium metal or magnesium based alloy melt should preferably be held before pouring at a temperature that is not lower than about 670° C. for at least 5 minutes after the components loaded into the melting crucible including vanadium metal containing grain refiner have melted, or after vanadium metal containing grain refiner was added to the melt. It is not necessary for the temperature of the melt to exceed about 800° C. unless required for a purpose different to grain refinement with vanadium metal. Likewise, no added benefit will be attained if the melt is held before pouring for longer than about 35 minutes, especially at temperatures that are above approximately 770° C.

Preferably, additional stirring of the melt containing the vanadium metal containing grain refiner may be applied. The use of vanadium metal as a grain refiner can also be adapted to any casting procedure (sand casting, permanent mould casting, etc.).

By using a grain refiner comprised of vanadium metal alone or vanadium metal in the combination with one or more alloying elements intended to be present in the magnesium alloy, it is possible to produce uniform grain size of cast alloys which is at least two times smaller than when the said grain refiner is not used, thereby significantly improving the mechanical properties of cast alloys and wrought products, particularly the tensile properties in the as-cast state. The innovative vanadium metal containing grain refiner is also particularly effective as a grain growth inhibitor during any of the commonly applied heat treatments of as-cast alloys, such as homogenization, solution heat treatment or pre-heating prior to or during warm mechanical processing. This is an added advantage of the present innovative grain refiner over other grain refining agents used to grain refine magnesium metal or magnesium based alloys.

The inventive vanadium grain refiner is applicable to all magnesium-based alloys and to both cast and wrought magnesium based alloys, particularly those where magnesium comprises more than 75 wt % (weight percent). Most common commercial and experimental magnesium alloys include: 1) alloys based on Mg—Zn system, including those containing Cu (ZC), or Mn (ZM), or rare earths (ZE, EZ); 2) alloys based on Mg—Al system, particularly those also containing Zn (AZ), Mn (AM), Si (AS) or rare earths (AE), also those containing Sr (AJ); 3) alloys based on Mg—Y—RE system (WE); 4) the Mg—Ag—RE based alloys (QE, EQ); 5) the Mg—Sn based alloys including also elements such as Si, Zn and/or Al; 6) the Mg—Th based alloys (HK, ZH, HZ); Mg—Bi based alloys, etc. The practice of this invention is applicable to all these groups of alloys. It is particularly applicable to Mg—Zn based alloys.

In addition to its exceptional grain refining and grain growth inhibiting potency, vanadium metal is also a particularly desirable alloying element especially for precipitation hardened alloys. In such alloys, presence of a trace amount of vanadium in the magnesium solid solution significantly improves the magnitude and kinetics of hardening during ageing. Vanadium therefore has a multiple beneficial effect on some alloys, which is not observed with grain refiners such as zirconium or carbon and carbon-bearing compounds. This makes vanadium a highly suitable and preferred choice as grain refiner even for magnesium alloys that have traditionally been grain refined by zirconium.

Other features of the invention and its advantages will become apparent from the accompanying figures and an example presented. The procedure of grain refining is illustrated using an example of an Mg—Zn alloy. Mg—Zn based alloys comprise a large fraction of currently available alloys. Example presented provides comparison between Mg—Zn alloy that was grain refined by vanadium (grain refined alloy; Alloy 2) with a similar Mg—Zn alloy (referred to as the binary alloy or Alloy 1) that was not grain refined.

DETAILED DESCRIPTION OF THE FIGURES

Figure 1:
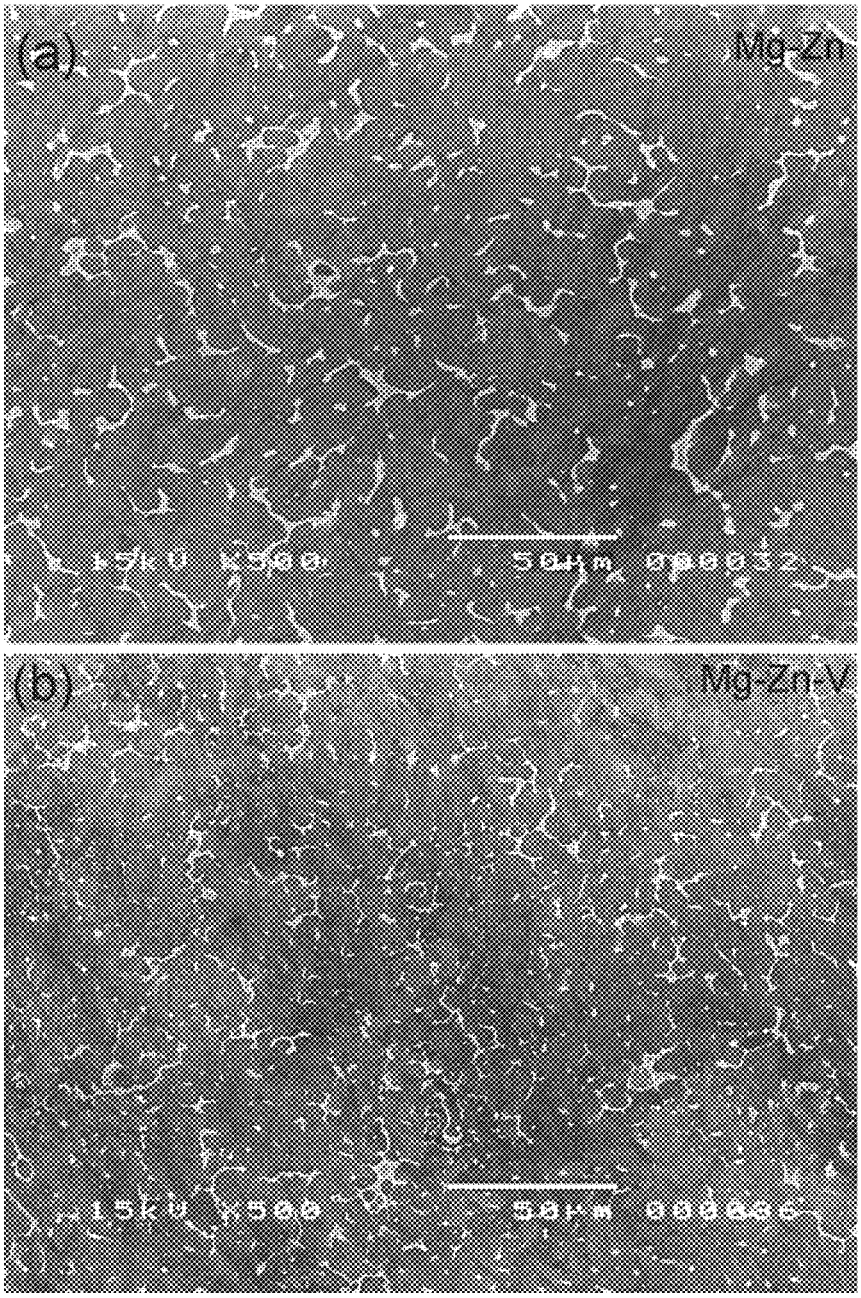
FIG. 1 presents scanning electron microscope (SEM) images of the binary Mg—Zn alloy (a) and Mg—Zn alloy grain refined by V (b) in the as-cast states showing the size and distribution of constituent particles (the eutectic phase; bright contrast) outlining the grain boundaries.

FIG. 1 shows the SEM images and compares the microstructures of the two alloys produced by casting. The binary Mg—Zn alloy and the Mg—Zn alloy grain refined by pure vanadium metal, after melting and casting had the compositions given in Table I (expressed in weight percent; wt %). Both alloys were prepared following identical casting procedures. The vanadium metal was added in the pure form and melted together with the pure magnesium and an Mg—Zn pre-alloy using an induction melting furnace under the protective argon atmosphere. Both alloys were cast into a permanent mould as cylindrical bar. Specimens for SEM and optical microscopy observations were taken from the central section of the cylindrical bars. FIG. 1 shows refined microstructure of the as-cast grain-refined alloy (b) as compared to as-cast binary alloy (a).

TABLE I

| Alloy | Alloy composition | Homogenisation | $\overline{N_A}$ | Grain size (μm) |
|---|---|---|---|---|
| Alloy 1 (binary) | Mg—7Zn (wt %) | 335° C.-96 h | 628 | 40 |
| Alloy 2 (grain refined by V) | Mg—7Zn—0.3V (wt %) | 340° C.-19 h | 2538 | 20 |
| ZC | Mg—6Zn—3Cu—0.1Mn (wt %) | 440° C.-48 h | 824 | 35 |

The particles outlining the grain boundaries were finer and more densely dispersed in the grain refined alloy (FIG. 1*b*). It is evident that the grain size of the alloy grain refined by vanadium is smaller than that of the binary alloy.

The small grain size of the as-cast alloy grain refined by vanadium was retained even after homogenization heat treatment. Both cast alloys (Mg—Zn and Mg—Zn—V) were homogenized and the details of these heat treatments are given in Table I. Homogenization is a common procedure aimed to reduce any compositional inhomogeneities of cast alloys. Most cast products, especially cast alloys aimed for further processing into wrought products, are homogenized prior to application and/or further processing, thus the as-homogenized microstructure was considered as representative of the grain refining effectiveness of the innovative vanadium metal grain refining agent. Homogenization involves long term heat treatment of as-cast alloy at an elevated temperature, which is typically slightly lower (by 5-40° C.) than the alloy's melting temperature. However, some agents that act as grain refiners during solidification do not inhibit grain growth during elevated temperature heat treatment, such as homogenization or solution heat treatment, so the benefits of the small grain size can be lost when alloy is thermo-mechanically processed. A successful grain refiner suitable for industrial application is expected to retain its effect even after repetitive alloy thermo-mechanical processing.

Figure 2:
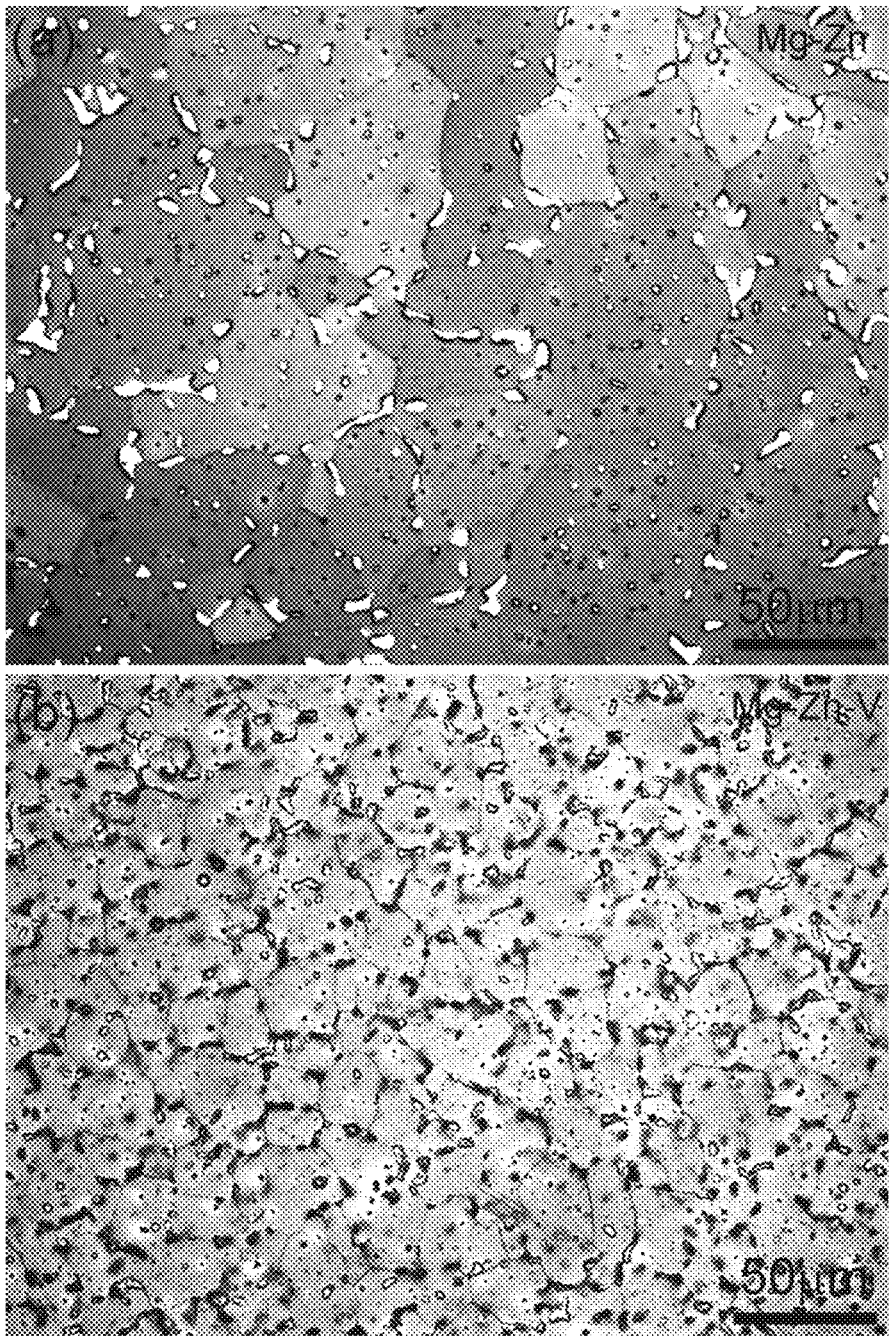
FIG. 2 shows optical microscopy images of the binary Mg—Zn alloy (a) and Mg—Zn alloy grain refined by V (b) in the as-homogenized conditions which clearly indicate the difference in the grain sizes between the two alloys.

FIG. 2 shows optical microscopy images of the two alloys in the as-homogenized conditions (binary alloy—(a); grain refined alloy—(b)). Specimens for optical microscopy were etched using acetic picral in order to reveal grain boundaries. It is evident from these images that the vanadium addition resulted in a significant grain refinement of the Mg—Zn alloy which is fully retained even after homogenization. The quantitative analysis of the grain sizes after homogenization is also given in Table I. These results show that the average number of grains per square millimeter of the ingot cross-section (designated as $\overline{N_A}$) was an order of magnitude higher in the alloy grain refined by vanadium. Accordingly, the grain size of the alloy grain refined by vanadium was at least half the grain size in the alloy which was not grain refined. The "Grain size" was taken to be equal to a side of a square grain having an area of $1/\overline{N_A}$, in accordance with the ASTM standard procedure applied for the grain size measurement.

Alloying inevitably leads to some grain refinement, however some elements act as exceptionally potent grain refiners and this justifies their wider technological application for this specific purpose. For comparison, results for a ZC type alloy are provided in Table I to illustrate that a trace amount of vanadium (0.3 weight percent which is only about 0.15 atomic percent) is an outstandingly more effective grain refiner than a considerably higher amount of common alloying elements such as Cu together with Mn (about ten times greater amount in both atomic and weight percent) for a similar Zn content in the alloy.

Figure 3:
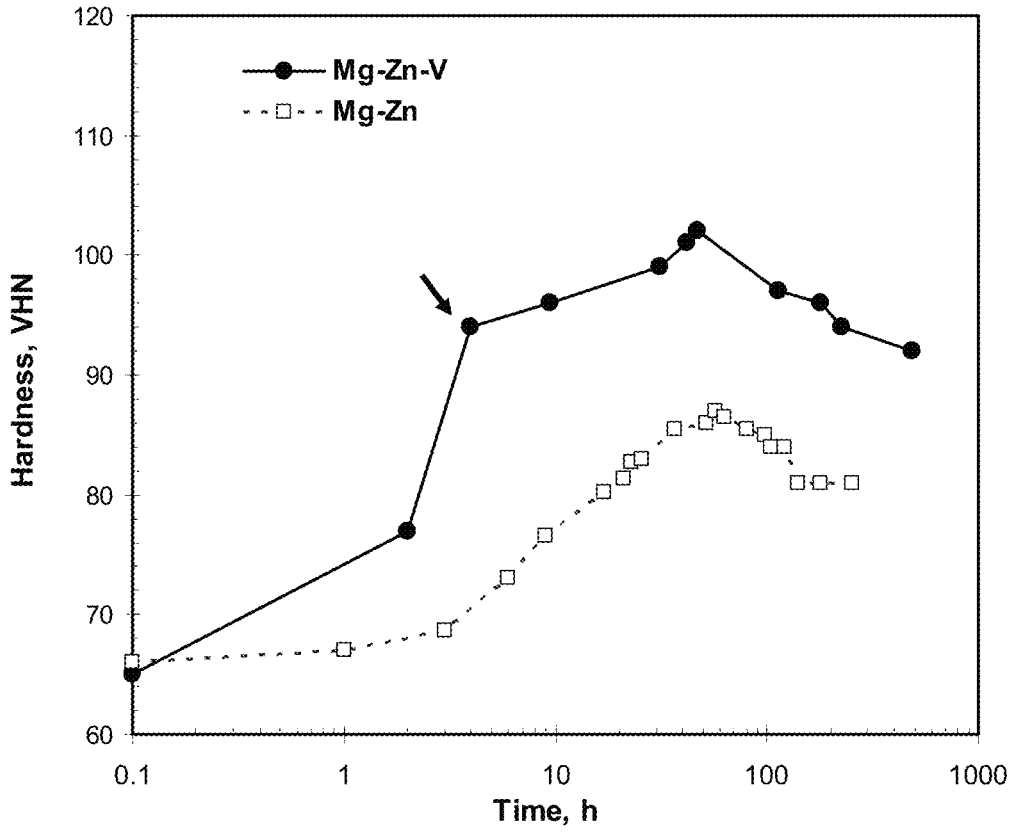
FIG. 3 shows hardness vs. ageing time plots for ageing temperature of 160° C. (T6 temper) of the Mg—Zn alloy grain refined by vanadium metal (solid line) compared with that of the binary Mg—Zn alloy (broken line).

FIG. 3 shows hardness vs ageing time plots for the Mg—Zn alloy grain refined by vanadium metal compared with that of the binary Mg—Zn alloy. The ageing was performed at 160° C. after both alloys were solution heat treated and quenched in water. Solution heat treatment was conducted for about 4 hours at temperatures that were equal to the respective homogenization temperatures of each alloy (Table 1). These plots show that vanadium metal grain refiner strongly benefits the age hardening response of Mg—Zn alloy. It should be noted that Mg—Zn based alloys have traditionally been grain refined by zirconium (eg Mg—Zn—Zr or ZK series of alloys). Unlike zirconium which has no effect on age hardening but only acts as a grain refiner, vanadium significantly improves the age hardening response by nearly doubling the hardness increment (from the as-quenched state to peak-aged condition) of Mg—Zn based alloy.

Zirconium exhibits a certain solubility in magnesium lattice (maximal solubility under the equilibrium conditions is about 1 atomic percent). The solubility of vanadium in magnesium is almost negligible according to the available Mg—V phase diagram, although this may be affected by the presence of other alloying elements. A small amount of vanadium that is dissolved in the liquid alloy and which does not play a role in grain refinement may then be retained in the magnesium lattice. Without wishing to be restricted to any particular mechanism, it is suspected that due to the extremely small solubility of vanadium in the magnesium lattice, vanadium tends to precipitate out of magnesium solid solution after or even during quenching and interact with vacancies and alloying elements that are also precipitating out of the magnesium solid solution (in this example zinc) to form co-clusters. It is known from studies on precipitation hardened alloys in general that such interactions between alloying elements that take place at a very early stage of ageing heat treatment are likely to have a beneficial and often critical effect on the age hardening response by promoting the nucleation of strengthening precipitates and/or by accelerating the kinetics of ageing. FIG. 3 shows that in the presence of vanadium, Mg—Zn alloy reaches peak hardness after a significantly shorter period of time, with nearly 95% of the peak hardness being achieved after only 4 hours (arrowed). On the other hand, during ageing of the binary Mg—Zn alloy which was not grain refined using inventive vanadium metal containing grain refiner there was an incubation period of about 6 hours before onset of hardening. The magnitude of hardening and strengthening in the vanadium grain refined alloy is nearly doubled as compared to binary alloy. Vanadium therefore a) accelerates the kinetics of precipitation during ageing, and b) significantly increases the magnitude of hardening (nearly doubled in the case of Mg—Zn based alloy) in addition to having grain refining and grain growth inhibiting effects. There is therefore a significant advantage in using innovative vanadium grain refiner as compared to other more traditional grain refiners.

Figure 4:
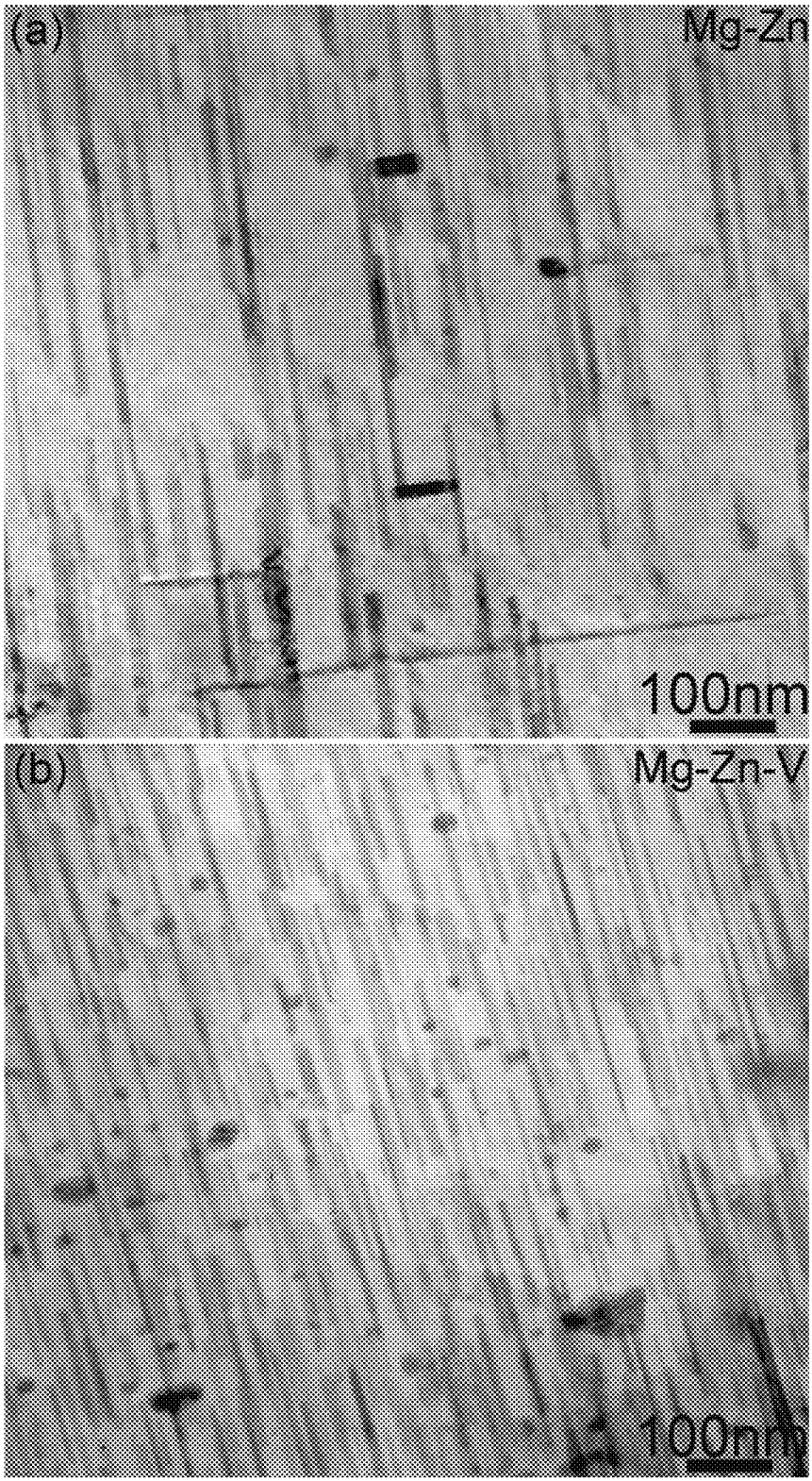
FIG. 4 shows transmission electron microscopy (TEM) images of microstructures corresponding to peak hardness in the T6 conditions of the binary Mg—Zn alloy (a) and Mg—Zn alloy grain refined by V (b).

FIG. 4 shows TEM images of the T6 peak aged conditions of Mg—Zn (a) and Mg—Zn—V (b) alloys. The dark elongated features and those of prismatic or irregular morphology are strengthening precipitates formed during the T6 heat treatment at 160° C. These precipitates are perpendicular to the basal plane of magnesium. FIG. 4 shows that the magnitude of strengthening in the vanadium grain refined alloy (b) as compared to binary alloy (a) is nearly doubled because the number density of the strengthening precipitates is significantly increased after vanadium metal containing grain refiner was used. A notably greater number of finer mainly elongated and some prismatic precipitates formed by ageing in the Mg—Zn—V alloy and after a shorter period of time than in the binary alloy. This indicates that vanadium significantly promotes the nucleation of strengthening precipitates.

Finally, it is to be understood that various alterations, modifications and/or additions may be introduced into the constructions and arrangements of parts previously described without departing from the spirit or ambit of the invention.

What is claimed is:

1. A process of grain refining magnesium metal or magnesium based alloy including the step of a) providing a melt of the magnesium metal or magnesium based alloy, said melt including a grain refining agent in an amount effective to induce grain refinement of said magnesium metal or magnesium based alloy upon solidification, where said grain refinement in the solidified magnesium metal or magnesium based alloy comprises a reduction in average grain size of at least 50% (percent) as compared with the average grain size without addition of said grain refining agent;

wherein melting of the magnesium metal or magnesium based alloy is conducted at a temperature of at least 670° C., and the melt is held at the melting temperature for a period of time sufficient to allow for the grain refining agent to become active;

wherein the grain refining agent is vanadium metal added in the form of pure or elemental vanadium metal, or the grain refining agent is vanadium metal added in the form of a master alloy or pre-alloy of vanadium with one or more alloying elements present in the magnesium based alloy which is being grain refined;

wherein the grain refining agent is added to the magnesium metal or magnesium based alloy after formation of the melt; or the grain refining agent is added to the magnesium metal or magnesium based alloy prior to formation of the melt; and the grain refining agent is added to said magnesium metal or magnesium based alloy in an amount of up to 2 wt % (weight percent) equivalent of vanadium metal.

2. The process of claim 1, where the amount of the grain refining agent is additionally effective to inhibit grain growth during a subsequent heat treatment of the solidified magnesium metal or magnesium based alloy.

3. The process of claim 1 further including stirring of the melt of magnesium metal or magnesium based alloy containing the grain refining agent where the said stirring is conducted mechanically or by induction heating.

4. The process of claim 1 in which the magnesium metal or magnesium based alloy is melted at a temperature between 670° C. and 800° C.

5. The process of claim 1 in which the melt is held at the melting temperature for a period of time of at least 5 minutes.

6. The process of claim 1 in which the grain refining agent is added to said magnesium metal or magnesium based alloy in an amount of about 0.005 to 0.3 wt % (weight percent) equivalent of vanadium metal.

7. The process of claim 1 including the further steps of:

b) subjecting the solidified magnesium based alloy to a first heat treatment at a temperature for a time sufficient to effect the dissolution of the alloying elements into magnesium solid solution;

c) quenching; and d) subjecting the quenched magnesium based alloy to a second heat treatment sufficient to result in the formation of clusters or precipitates containing alloying elements throughout the alloy grains which were at least partially nucleated by vanadium metal present in the magnesium solid solution.

8. The process of claim 7 where the first heat treatment is conducted at a temperature of 5° C. to 50° C. below the melting point of the magnesium based alloy for a time of at least 30 minutes.

9. The process of claim 7, where the temperature of the second heat treatment is below 280° C.

10. The process of claim 7, where the temperature of the second heat treatment is above 100° C.

11. The process of claim 1 in which the melt is held at the melting temperature for a period of time of 5 to 10 minutes.

12. The process of claim 7, where the temperature of the second heat treatment is above 150° C.

13. The process of claim 7, where the temperature of the second heat treatment is above 170° C.

14. The process of claim 10 or 12 or 13 where the second heat treatment is conducted for at least 20 minutes.

* * * * *